US006918321B1

(12) United States Patent
Whittaker

(10) Patent No.: US 6,918,321 B1
(45) Date of Patent: Jul. 19, 2005

(54) SHINGLE RIPPER

(76) Inventor: William Whittaker, 174 Elmendorf St., Kingston, NY (US) 12401

( * ) Notice: Subject to any disclaimer, the term of this patent is extended or adjusted under 35 U.S.C. 154(b) by 0 days.

(21) Appl. No.: 10/795,899

(22) Filed: Mar. 8, 2004

(51) Int. Cl.[7] ..... E04D 15/00
(52) U.S. Cl. ..... 81/45; 81/46; 30/169; 254/131.1
(58) Field of Search ..... 81/45, 46; 254/131.5; 30/169, 172; 299/36.1; 16/430

(56) References Cited

U.S. PATENT DOCUMENTS

| | | | | |
|---|---|---|---|---|
| 4,704,758 | A | * 11/1987 | Hoffman | 15/144.4 |
| 5,465,971 | A | * 11/1995 | Tischler | 473/227 |
| 5,706,553 | A | * 1/1998 | Riley et al. | 16/111.1 |
| 6,190,266 | B1 | * 2/2001 | Pamias | 473/294 |
| 6,199,245 | B1 | * 3/2001 | Blessing | 16/430 |
| 6,453,774 | B1 | * 9/2002 | Khachatoorian | 81/45 |
| 6,488,266 | B2 | * 12/2002 | Macor | 254/25 |

OTHER PUBLICATIONS

Malco Catalogue—Roofing Tools Uni–Ripper.
Malco—Catalogue Beast–Shingle Remover.
Malco—The Beast Short Handled Shinge Remover.
Malco—Shinge Shovel.
Malco—Shingle Fork.

* cited by examiner

*Primary Examiner*—Joseph J. Hail, III
*Assistant Examiner*—Alvin J Grant

(57) ABSTRACT

A Shingle Ripper is provided for removing existing shingles from a roof. A claw which includes a generally triangularly-shaped plate with a front edge. The claw has a bottom surface and a top surface. The front edge of the claw has teeth. A handle, which is connected to the claw has a claw section which is the part of the handle affixed to the claw. A lower section is connected to the claw section and is located at an acute angle from the bottom surface. A lower intermediate section is connected to the lower section at an acute angle upwardly away from the bottom surface. An upper intermediate section is connected to the lower intermediate section at an acute angle downwardly toward the bottom surface. An upper section connected to the upper intermediate section at an acute angle upwardly away from the bottom surface. Hand grips are located on the lower intermediate section and the upper section.

12 Claims, 2 Drawing Sheets

SHINGLE RIPPER

BACKGROUND OF THE INVENTION

1. Field of the Invention

This invention relates to rippers for removing building materials and, more specifically, to a shingle ripper for removing existing roof shingles of all kinds from a roof.

2. Prior Art

When a new roof is required for a building, particular one having a sloped shingled roof, it is essential to remove the old roof. To add a new roof on top of an old roof results in a considerable amount of added weight on the structure which is obviously undesirable. Also, an existing roof dating back in time may have components which are now known to be hazardous and are thus best removed and disposed of in an appropriate manner. Therefore, in the installation of a new roof on an existing structure, the removal of the old roof will, in all likelihood, be a substantial part of the effort.

Rippers for the removal of roofing shingles are sold for the purpose of ripping or tearing the old shingles from the roof. These rippers work but are very strenuous to use and require the worker to stand on the roof. Such existing rippers use a claw which can be forced under the existing shingles and then, by means of a handle on the claw, pull the shingle from the roof. The handle on the existing rippers is a straight handle which is why the worker must stand on the roof. When removing shingles, the ripping starts at the top or peak of a sloping roof and the removal process continues downwardly to the lower edge of the roof. Standing on a sloping roof is dangerous and even a slight improper move can prove itself to be injurious. Thus, a ripper with a handle that permits the worker to sit on the roof is most advantageous. Similarly. a ripper which is ergonomically designed for the most effective use of the body of the worker would deter fatigue and provide a far safer work environment.

Objects

The objects of this invention are as follows:

1. To provide a ripper, specifically for removing old roof shingles, that is ergonomically designed for causing the least amount of stress to the worker.
2. To provide a ripper for roof shingles that provides increased safety to the worker.
3. To provide a ripper for roof shingles that is economical to produce and durable.

SUMMARY OF THE INVENTION

A Shingle Ripper is provided for removing existing shingles from a roof. The shingle Ripper includes a claw in the form of a plate with a front edge. The claw has a bottom surface and a top surface. The front edge has teeth. A handle is secured to the claw and the handle has a claw section which is the part which is affixed to the claw. A lower section is connected to the claw section and is located at an acute angle upwardly from the bottom surface.

A lower intermediate section is connected to the lower section at an acute angle upwardly away from the bottom surface. An upper intermediate section is connected to the lower intermediate section at an acute angle downwardly toward the bottom surface. An upper section is connected to the upper intermediate section at an acute angle upwardly away from the bottom surface.

Description of the Numerals

| NUMERAL | DESCRIPTION |
|---|---|
| 11 | Claw |
| 13 | Handle |
| 15 | Front Edge |
| 17 | Rear Tip |
| 19 | Teeth |
| 21 | Bottom Surface |
| 23 | Top Surface |
| 24 | Strengthening Members |
| 25 | Lower End |
| 27 | Upper End |
| 29 | Claw Section |
| 31 | Lower Section |
| 33 | Lower Intermediate Section |
| 35 | Upper Intermediate Section |
| 37 | Upper Section |
| 39 | Handle Grips |

DETAILED DESCRIPTION OF THE DRAWINGS

DETAILED DESCRIPTION OF THE PREFERRED EMBODIMENT

Figure 1:
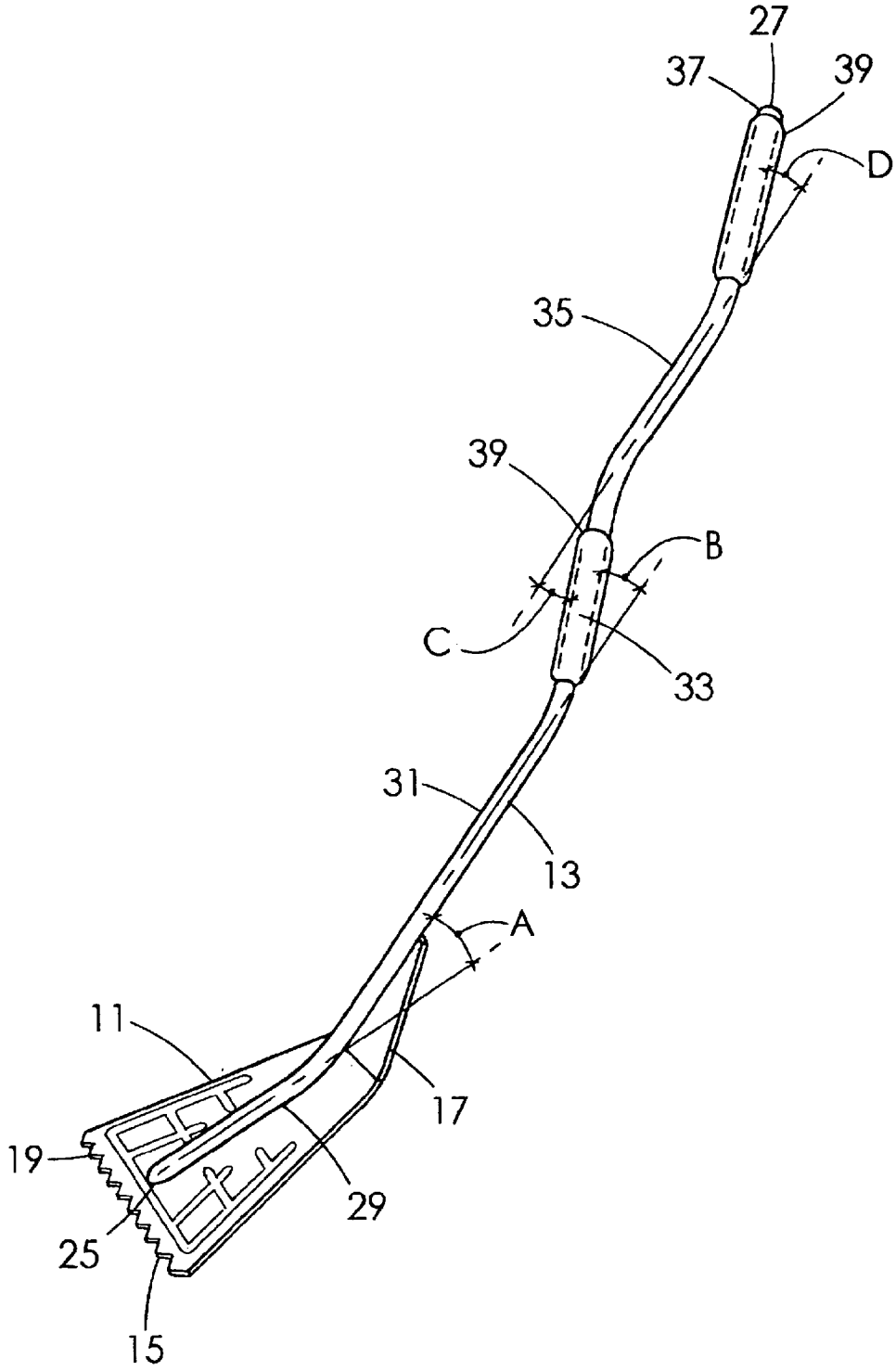
FIG. 1 is a perspective view of the shingle ripper showing the claw and the handle with the claw and showing the two hand grips and the multiple sections of the handle and their relationship to one another.
Figure 3:
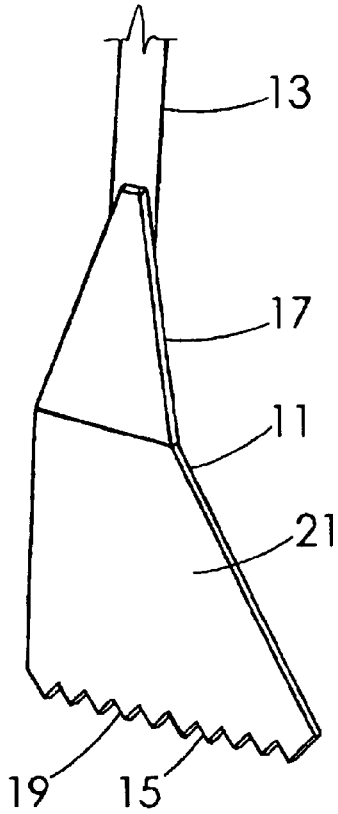
FIG. 3 shows the bottom surface of the claw and a portion of the handle at the lower end.
Figure 2:
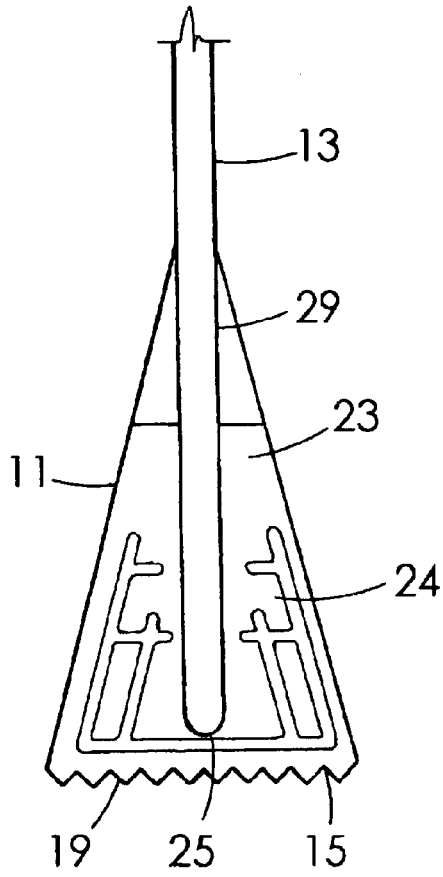
FIG. 2 shows the top surface of the claw and a portion of the handle at the lower end of the handle.

Referring now to FIG. 1, the Shingle Ripper is shown and includes a claw 11 and a handle 13. The claw 11 is a generally triangularly-shaped plate with a front edge 15 and a rear tip 17. The rear tip 17 of the claw 11 is bent upwardly to conform to the handle 13. Teeth 19 are located on the front edge 15 of the claw 19 and the teeth 19 are forced under an existing shingle on a roof. When the front edge 15 of the claw 11 is under the shingle, the front edge 15 of the claw 11 is forced upwardly, pulling the shingle loose. The claw 11 has a bottom surface 21 which is placed down on the roof. Opposite from the bottom surface 21 of the claw 11 is the top surface 23 of the claw. Strengthening members 24 are added to the top surface 23 to assure the rigidity of the claw 11.

A lower end 25 of the handle 13 is affixed rigidly to the claw 11 and an upper end 27 of the handle 13 is remote from the claw 11. The handle 13 has five separate sections preferably all formed together from one bar. The lowest section, located at the lower end 25, is the claw section 29, which is affixed to the claw 11 and, as previously stated, leaving four sections which are the operating sections of the handle 13. The lowest operating handle section, which is connected to the claw section 29, is the lower section 31. Directly above the lower section 31 is the lower intermediate section 33. Directly above the lower intermediate section 33 is the upper intermediate section 35 and above that is the upper section 37. The lower section 31 is moderately longer than the lower intermediate section 33 and the upper intermediate section 35 and the upper section 37. The lower intermediate section 33 and the upper intermediate section 35 and the upper section 37 are of comparable lengths. Handle grips 39 are located on the lower intermediate section 33 and the upper section 37.

The lower intermediate section 33 and the upper section 37 are substantially parallel to one another and thus the handle grips 39 are substantially parallel to one another. The result is a Shingle Ripper that permits the worker to sit on the roof and comfortably and efficiently force the Shingle Ripper under the existing shingles.

The rear tip 17 has previously been described as being bent upwardly away from the bottom surface 21 of the claw 11. For purposes of definition, the terms "upward" and "upwardly" indicate away from the bottom surface 21 and thus also the roof when the bottom surface 21 is on the roof. Similarly, the terms "downward" and "downwardly" means the opposite from "upward" and "upwardly" and indicates toward the bottom surface and the roof with the bottom surface 21 on the roof.

The configuration of the handle 13 creates an ergonomically efficient device. As best seen in FIG. 1, the lower section 31 is located at an angle A to the claw section 29 upwardly away from the bottom surface 21. The lower intermediate section 33 is bent upwardly from the lower section 31 at an angle B. The upper intermediate section 35 is bent downwardly from the lower intermediate section 33 by an angle C. The upper section 37 bends from the upper intermediate section 35 upwardly away from the bottom surface 21 at an angle D.

The angles A, B, C and D are preferably approximately thirty degrees but may have a range of twenty-five degrees to thirty-five degrees. As previously stated, the handle grips 39 on the lower intermediate section 33 and the upper section 37 are substantially parallel to one another. The result is a Shingle Ripper that permits the worker to sit on the roof and comfortably and effectively force the Shingle Ripper under the existing shingles.

It is to be understood that the drawings and descriptive matter are in all cases to be interpreted as merely illustrative of the principles of the invention rather than as limiting the same in any way since it is contemplated that various changes may be made in various elements to achieve the results without departing from the spirit of the invention or the scope of the appended claims.

What is claimed is:

1. A Shingle Ripper for removing existing shingles from a roof comprising:

a claw being a plate with a front edge, the claw having a bottom surface and a top surface, the front edge having teeth; and a handle including:

a claw section affixed to the claw, a lower section connected to the claw section and being located at an acute angle upwardly from the bottom surface, a lower intermediate section connected to the lower section at an acute angle upwardly away from the bottom surface, an upper intermediate section connected to the lower intermediate section at an acute angle downwardly toward the bottom surface, and an upper section connected to the upper intermediate section at an acute angle upwardly away from the bottom surface each acute angle being in the range of twenty five to thirty five degrees.

2. A Shingle Ripper according to claim 1 wherein the claw is a generally triangularly-shaped plate with a front edge.

3. A Shingle Ripper according to claim 1 wherein the claw is a generally triangularly-shaped plate with a front edge, the front edge having teeth.

4. A Shingle Ripper according to claim 1 wherein the claw has a rear tip, the rear tip being bent upwardly away from the bottom surface at an acute angle.

5. A Shingle Ripper according to claim 1 wherein the claw has a rear tip, the rear tip being bent upwardly away from the bottom surface at an acute angle in the range of approximately twenty-five to thirty-five degrees.

6. A Shingle Ripper according to claim 1 wherein the claw has a rear tip, the rear tip being bent upwardly away from the bottom surface at an acute angle of approximately thirty degrees.

7. A Shingle Ripper according to claim 1 wherein the lower intermediate section of the handle and the upper section of the handle are substantially parallel.

8. A Shingle Ripper according to claim 1 wherein each acute angle is approximately thirty degrees.

9. A Shingle Ripper for removing existing shingles from a roof comprising:

a claw being a generally triangularly-shaped plate with a front edge, the claw having a bottom surface and a top surface, the front edge having teeth;

a handle including:

a claw section affixed to the claw, a lower section connected to the claw section and being located at an acute angle from the bottom surface, a lower intermediate section connected to the lower section at an acute angle upwardly away from the bottom surface, an upper intermediate section connected to the lower intermediate section at an acute angle downwardly toward the bottom surface, an upper section connected to the upper intermediate section at an acute angle upwardly away from the bottom surface; and hand grips located on the lower intermediate section and the upper section, each acute angle being in the range of twenty five to thirty degrees.

10. A Shingle Ripper according to claim 9 wherein the claw has a rear tip, the rear tip being bent upwardly away from the bottom surface at an acute angle.

11. A Shingle Ripper according to claim 9 wherein each acute angle is approximately thirty degrees.

12. A Shingle Ripper for removing existing shingles from a roof comprising:

a claw being a generally triangularly-shaped plate with a front edge and a rear tip, the claw having a bottom surface and a top surface, the rear tip being bent upwardly away from the bottom surface at an angle of approximately thirty degrees, the front edge having teeth;

a handle including:

a claw section affixed to the top surface of the claw, a lower section connected to the claw section and being located at an angle upwardly from the bottom surface of approximately thirty degrees, the lower section being secured to the rear tip of the claw, a lower intermediate section connected to the lower section at an angle of approximately thirty degrees upwardly away from the bottom surface, an upper intermediate section connected to the lower intermediate section at an angle of approximately thirty degrees downwardly toward the bottom surface, an upper section connected to the upper intermediate section at an acute angle of approximately thirty degrees upwardly away from the bottom surface; the lower section being moderately longer than the lower intermediate section and the upper intermediate section and the upper section; and hand grips located on the lower intermediate section an the upper intermediate section.

* * * * *